US005802609A

United States Patent [19]

Garofalo

[11] Patent Number: 5,802,609

[45] Date of Patent: Sep. 8, 1998

[54] WATER-TIGHT DIVING SUIT

[75] Inventor: Giovanni Garofalo, Rapallo, Italy

[73] Assignee: HTM Sport S.p.A., Italy

[21] Appl. No.: 762,498

[22] Filed: Dec. 9, 1996

Related U.S. Application Data

[63] Continuation-in-part of Ser. No. 524,463, Sep. 7, 1995, abandoned.

[30] Foreign Application Priority Data

Sep. 14, 1994 [IT] Italy ..... GE94A0103
Jan. 11, 1995 [IT] Italy ..... GE950002 U

[51] Int. Cl.[6] ..... B63C 11/04
[52] U.S. Cl. ..... 2/2.17; 2/2.15
[58] Field of Search ..... 2/2.15, 2.17, 311, 2/338, 270, 275

[56] References Cited

U.S. PATENT DOCUMENTS 2,853,758 9/1958 Topf ..... 2/2.17
3,731,319 5/1973 O'Neill ..... 2/2.1
4,464,795 8/1984 Long et al. ..... 2/2.16
4,547,904 10/1985 Long et al. ..... 2/2.16

FOREIGN PATENT DOCUMENTS 2133274 7/1994 United Kingdom ..... 2/2.16
2277433 11/1994 United Kingdom ..... 2/2.15

*Primary Examiner*—C. D. Crowder
*Assistant Examiner*—Larry D. Worrell, Jr.
*Attorney, Agent, or Firm*—Larson and Taylor

[57] ABSTRACT

A water-tight diving suit has the edges of the open extremities of the sleeves and the trousers of the suit and the neck provided with a hem which is folded inwards and secured, for example by stitching, to the inside edge of the suit, so as to form a tubular pocket. A tape-like stiffening element made of elastomeric material is housed inside this pocket. The suit can be made as a one-piece or two-piece suit. In the case of one-piece suits, which combine both jacket and trouser parts, these have, in the region of the access opening which can be closed by a zipper, an edge with a hem folded inwards and secured, for example by stitching, to the inside edge of the suit, so as to form a tubular pocket, inside which a tape-like element made of elastomeric material is housed. The suit may be further provided with a separate hood.

7 Claims, 4 Drawing Sheets

WATER-TIGHT DIVING SUIT

CROSS REFERENCES TO RELATED APPLICATIONS

This invention is a continuation-in-part of my application Ser. No. 08/524,463, filed Sep. 7, 1995, now abandoned.

BACKGROUND OF THE INVENTION

The present invention relates to a diving suit, and in particular to a thermally insulated suit, commonly known as a drysuit.

It is known that in order to dive to great depths and/or in particularly cold waters, and/or for particularly long periods of time, divers need to wear suits made from a material, in particular neoprene, which is 5 or 7 mm thick.

However, in addition to the thickness of the suit, particular importance is also placed on the degree of water-tightness afforded by the openings of the free extremities. The extremities include those of the sleeves and trousers of the suit, as well as around the neck, and by the closure zippers and the various points at which suits of more than one piece are joined.

This is because infiltration of water at these critical points could cause the temperature inside the suit to drop, consequently putting the diver wearing the suit at risk, or at the very least causing him great discomfort. Generally, this disadvantage is overcome as shown for instance by GB-A-2 076 277 or by FR-A-2 561 200 by providing a double thickness of material around the open extremities or by narrowing the opening itself; this may however give rise to problems of circulation in the extremities of the limbs in question, and in addition these types of suit can be awkward to put on.

From GB-A-2 133 274 a personnel protective garment of the kind above described is known wherein the garment is hemmed at each aperture by means of an inflatable tube, and the garment is provided with means for inflating and deflating the tube.

Whenever said garments are used in industry and by people such as firemen, that is at atmospheric pressure, as mentioned in the above patent, there are no particular problems due to the environmental pressure. But whenever such a garment is used by under sea divers, during diving the inflated tube will be compressed by the increasing underwater pressure. This means that the inflated tube will no longer be able to provide the requested sealing action.

SUMMARY OF THE INVENTION

The present invention enables these and other disadvantages to be overcome by providing a diving suit which gives a high degree of heat insulation and which is both easy to put on and comfortable to wear.

The subject of the present invention is therefore a diving suit in which the edges of the open extremities of the sleeves and trousers of the suit and the neck have a hem which is folded inwards and is stitched or otherwise secured to the inside edge of the suit so as to form a tubular pocket, and by housing inside of said tubular pocket a tape-like element made of elastomeric material.

Advantageously, this tape-like element has a circular or approximately circular cross-section, and has a diameter slightly smaller than the internal diameter of the tubular pocket in which it is housed.

According to a variant of the invention, it has proven particularly advantageous to make this tape-like element in the form of a tubular element.

The suit according to the invention can be a two-piece suit, that is with a jacket and trouser part, or a one-piece suit.

In the case of one-piece-suits, at least one edge of the opening providing access to the suit has a hem folded inwards, in order to form a tubular pocket, in which a tape-like stiffening element with a diameter slightly smaller than the diameter of the tubular pocket, is housed.

In an additional embodiment of the invention, the open extremities of the sleeves and trousers have an additional sealing element formed by a strip which can be secured by wrapping one of its two ends over the other, these ends being provided with a fastening system such as a zipper, buttons or the like. Advantageously, this fastening element is made up of a pair of elements of the type commercially known as VELCRO, a hook and loop fastener.

It is known that particularly the diving suits for diving to great depths and/or in cold water must be provided with a hood.

Usually, hoods are formed integral with the suit. However, this implies that the hood is formed quite large in correspondence with the neck and with the back of the neck of the user, in order to allow users to easily put the suit on with the hood. However, this permits infiltration of water at these locations of the suit, which is of great disadvantage. It is also known to form hoods separated from the suit, by providing the hoods with an ample skirt which is accomodated inside of the neck portion of the suit. However, also by this arrangement the infiltration of water may not be avoided.

It is therefore an additional object of the invention to provide the diving suit of the invention with a hood which is separated from the suit. The hood is provided with a depending skirt adhering to the neck of the user which is formed or lined at its inner side, with smooth waterproof elastomeric material, and in which the neck portion of the suit is provided with a collar the outer portion of which is also made from smooth waterproof elastomeric material, so as to assure the seal between the hood and collar of the suit.

Advantageously, the edge of the collar of the suit may be provided with a folded hem housing a tape-like element of elastomeric material.

BRIEF DESCRIPTION OF THE DRAWINGS

Further advantages and characteristics will be clear from the following description of an embodiment of the present invention, which description is given by way of non-limiting example with reference to the appended drawings, in which.

DESCRIPTION OF THE PREFERRED EMBODIMENT OF THE INVENTION

Figure 1:
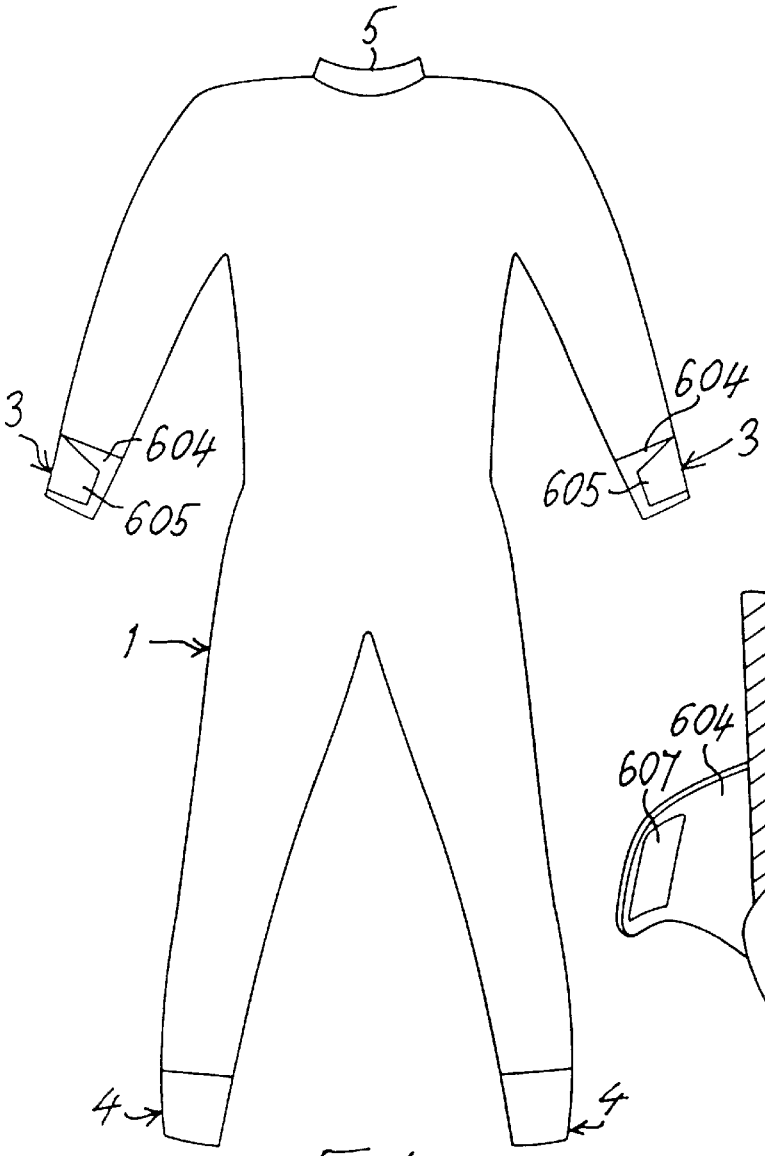
FIG. 1 is a front view of a diving suit according to the invention.

With reference to the drawings, and with particular reference to FIG. 1 thereof, the reference numeral 1 denotes the diving suit according to the invention. This suit is a one-piece suit, in other words with the jacket and trouser parts stitched together, and is put on by climbing in via the back, through an opening 2 which is closed with a transverse zipper 201 (FIG. 4) which extends virtually right across the shoulders, with sealing elements being provided around both the limb extremities (wrists 3 and ankles 4) and the diver's neck (neck seal 5), as will be described in greater detail below.

Figure 2:
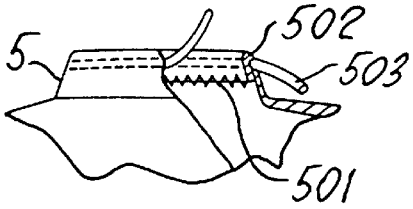
FIG. 2 is a detail of the neck seal of the suit of FIG. 1, shown on an enlarged scale and with parts in section.

With reference to FIG. 2, the hem of the neck 5 is folded inwards, and is stitched at 501 to the inside edge, so as to form a tubular pocket 502 which extends around the entire perimeter of the neck 5, and which houses a tape-like ring 503 made of elastomeric material and having a circular cross-section of diameter slightly smaller than the internal diameter of the tubular pocket 502 in which it is housed.

Figure 3:
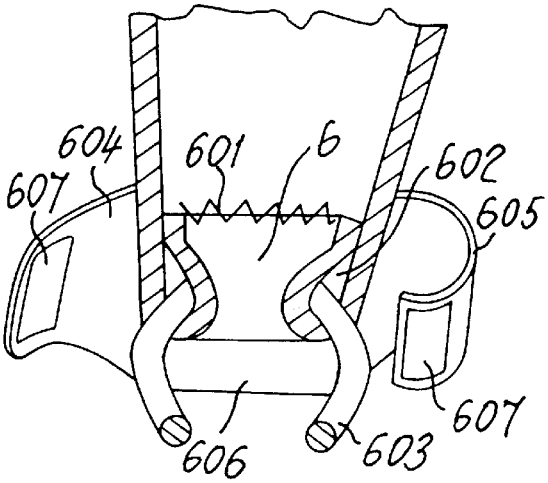
FIG. 3 is a detail of a sealing element for the limb extremities (wrists and/or ankles) of the suit of FIG. 1, shown on an enlarged scale and in longitudinal section.

FIG. 3 illustrates the system used to seal the extremities 3 and 4 of the sleeves and trousers respectively. In a manner completely similar to that described for the neck 5, both the extremities 4 of the trousers and the extremities 3 of the sleeves have a hem 6 which is folded inwards and stitched at 601 to the inside edge of the sleeve, or respectively of the trousers, so as to form an annular tubular pocket 602 which extends around the entire perimeter of the wrist, or respectively of the ankle, of the wearer, and which houses a tape-like ring 603 made of elastomeric material and having a circular cross-section of diameter slightly smaller than the internal diameter of the tubular pocket 602 in which it is housed. In addition, around both the wrists and the ankles, the sleeves and trousers of the suit are fitted with an open external wrap-around band 604, 605 which can be secured around the extremities of both the trousers and the sleeves by wrapping one of its ends around the other, these ends bearing a fastening element 607, for example of the type known under the trade name VELCRO, a hook and loop fastener.

As is more clearly illustrated in FIG. 3, this band 604, 605 extends a few centimeters beyond the bottom of the hem 6, with a band 606, so that when the band 604, 605 is closed around the wearer's wrist by means of the fastening elements 607, it also surrounds that part of the wrist not covered by the sleeve of the suit.

Figure 5:
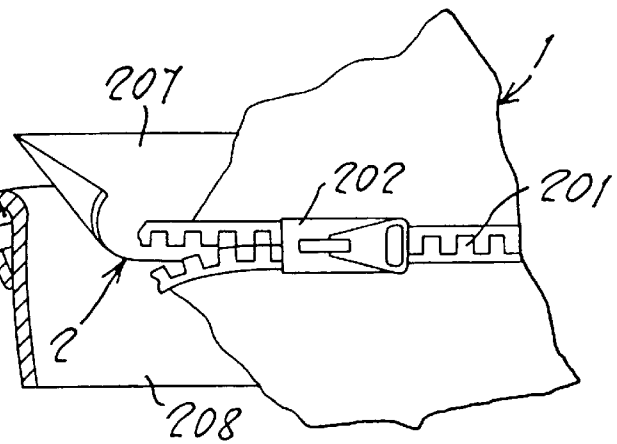
FIG. 5 is a detail of the sealing system around the zipper via which the suit of FIG. 4 is put on, shown on an enlarged scale and with parts in section.
Figure 4:
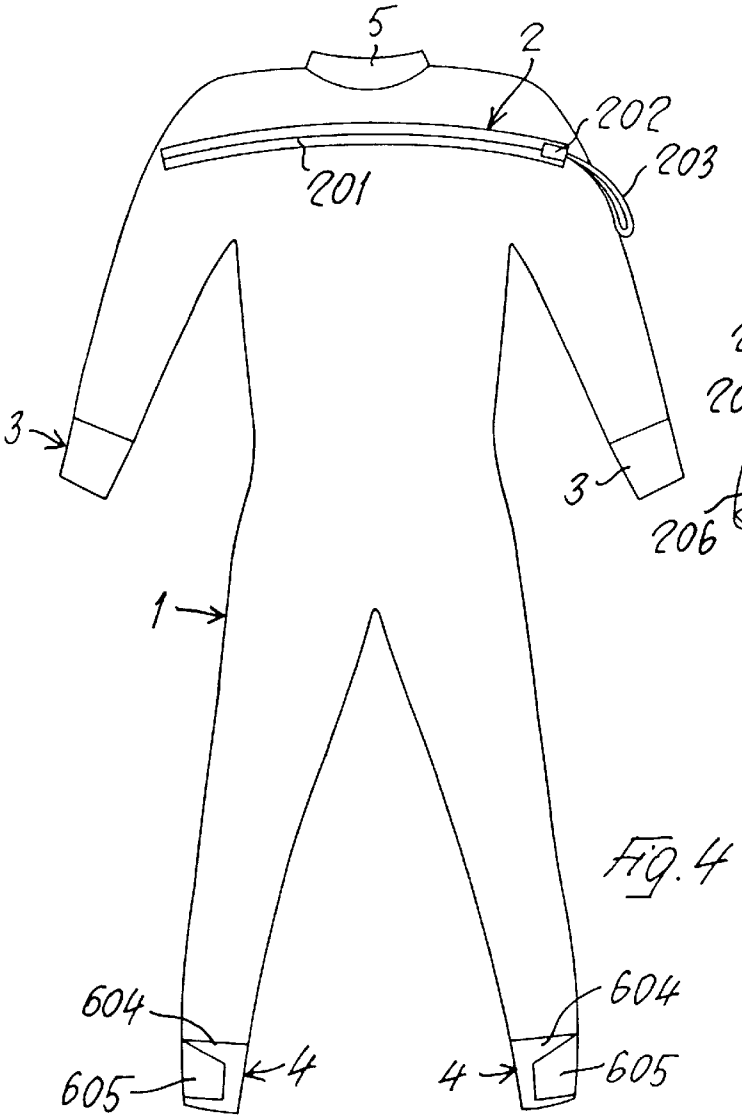
FIG. 4 is a view of the suit of FIG. 1, showing the back of the suit.

With reference to FIGS. 4 and 5, a description will now be given of the sealing system provided around the zipper 201 via which the suit is put on, which zipper is fitted in the opening 2 providing access to the suit. This access opening 2 is made in the top part of the back of the suit, approximately across the shoulder blades of the wearer, and is fitted with a zipper fastener 201, the slide 202 of which has a tab 203 for easy opening and closing. With reference to the detail illustrated in FIG. 5, it will be noted that, as in the description given for the neck and openings of the extremities of the suit, the opening 2 also has an edge with a hem 204 folded inwards and stitched to the inside edge of the back of the suit 1, so as to form a tubular pocket 205 which extends across the entire length of the opening via which the suit is put on, and which houses a tape-like element 206 made of elastomeric material and having a circular cross-section of diameter slightly smaller than the internal diameter of the tubular pocket 205. Needless to say, this tape-like element 206 is secured at both ends of the tubular pocket 205 in which it is contained. Advantageously the opening 2 is made, as described and illustrated, perpendicularly to the longitudinal axis of the suit and is located on the back of the latter, across the shoulders. In this way the weight of the air cylinders carried across the shoulders can be subsequently positively exploited, increasing the water-tightness of the overlapping edges 207 and 208 of the opening 2. However, it goes without saying that this opening 2 can also be made in other parts of the suit.

The way in which the diving suit according to the invention works will be clear from the following description. As described previously, at each opening of the suit according to the invention a hem (502, 602, 204) is formed. The turned-back part of this hem constitutes a channel which houses a sealing element which consists, in the case of the extremity 3 of the sleeves and the extremity 4 of the trousers, as well as the neck 5, of a ring (503, 603) of elastomeric material, whereas in the case of the access opening 2, it consists of a cord (206) stretched between the two ends of the opening and secured thereto. The purpose of these rings, or of this cord, is to firmly press the edges of the sheaths (502, 602) containing them against the skin of the diver wearing the suit, in the manner of a true "toroidal seal", thereby keeping water infiltration and therefore heat loss, to a minimum.

In particular, the hems 6 of the trousers and sleeves stop a few centimeters short of the wearer's wrists and ankles, so that it is the very act of putting on the suit which facilitates the sealing action afforded by the elements 602, 603. The strips 604, 605, which are secured around the wrists and ankles by wrapping one of their free ends around the other and fastening them together, ensure, together with the element 606 which extends beyond the hem 6, an even more efficient sealing action by providing further stability at the free ends of the sleeves and trousers of the suit.

DESCRIPTION OF ANOTHER EMBODIMENT OF THE INVENTION

Figure 7:
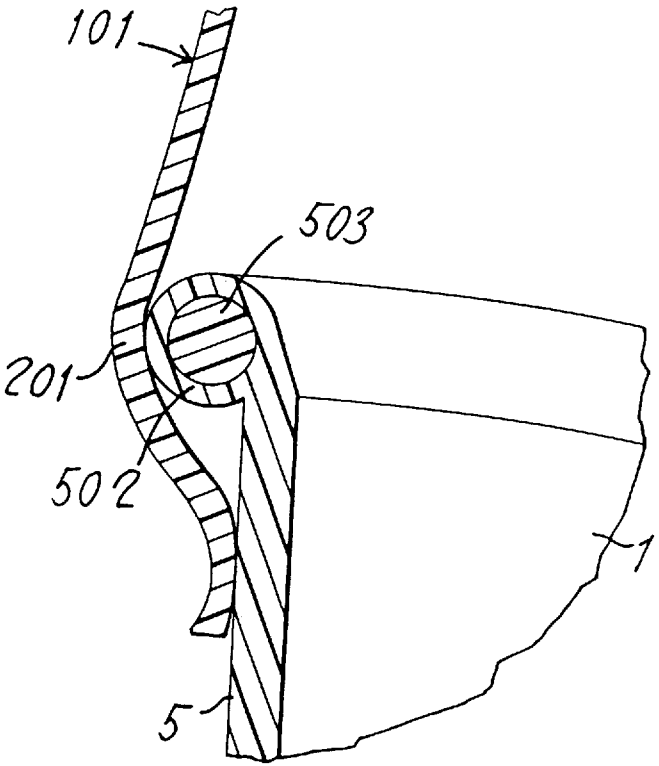
FIG. 7 is a longitudinal sectional view of an enlarged detail of the suit of FIG. 6, and FIGS. 8 and 9 are a detail of a sealing element for the sleeve and trouser, according to a further embodiment of the invention.
Figure 6:
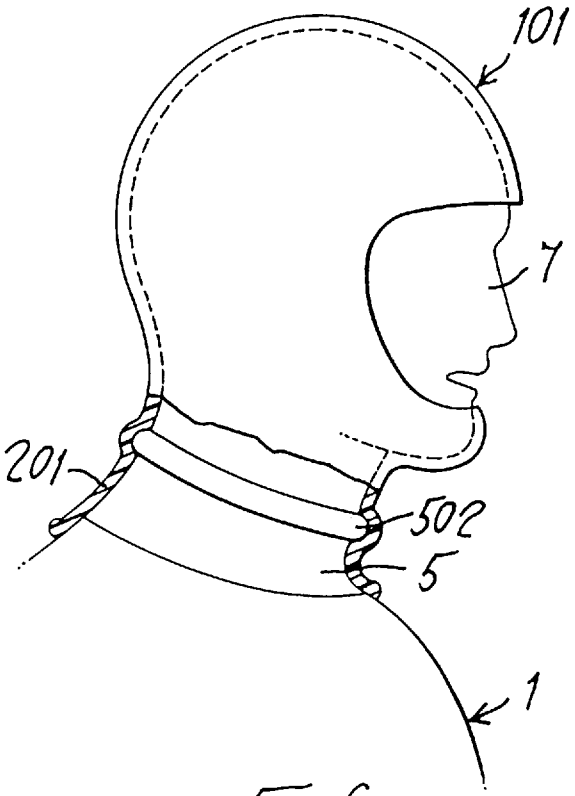
FIG. 6 is a partially sectioned side view, of a diving suit according to the invention, provided with a hood according to the invention.

With reference to FIGS. 6 and 7, a hood for a suit according to the invention will be described.

The hood 101 shown is provided with a depending skirt 201, forming the neck portion of the hood, the inner side of which is made from smooth neoprene. The said neck portion 201 is formed so as to tightly adhere to the neck of the user, once worn by a user 7. The user is wearing a diving suit 2 according to the invention, provided with a collar 5 the external side of which is also made from smooth neoprene. The skirt 201 of the hood extends so as to overlap the collar 5, as shown in the drawings.

It will be evident that, thanks to the contact between the two smooth neoprene surfaces of the collar 5 and the skirt 101 of the hood, a waterproof seal between said parts will be provided. Moreover, the external edge of the collar 5, with the hem 502 of circular cross section act as a further barrier, thus enhancing the waterproof seal between the two elements.

In conclusion, the suit according to the invention provides improved heat insulation combined with ease of use and of wear.

DESCRIPTION OF A FURTHER EMBODIMENT OF THE INVENTION

Figure 8:
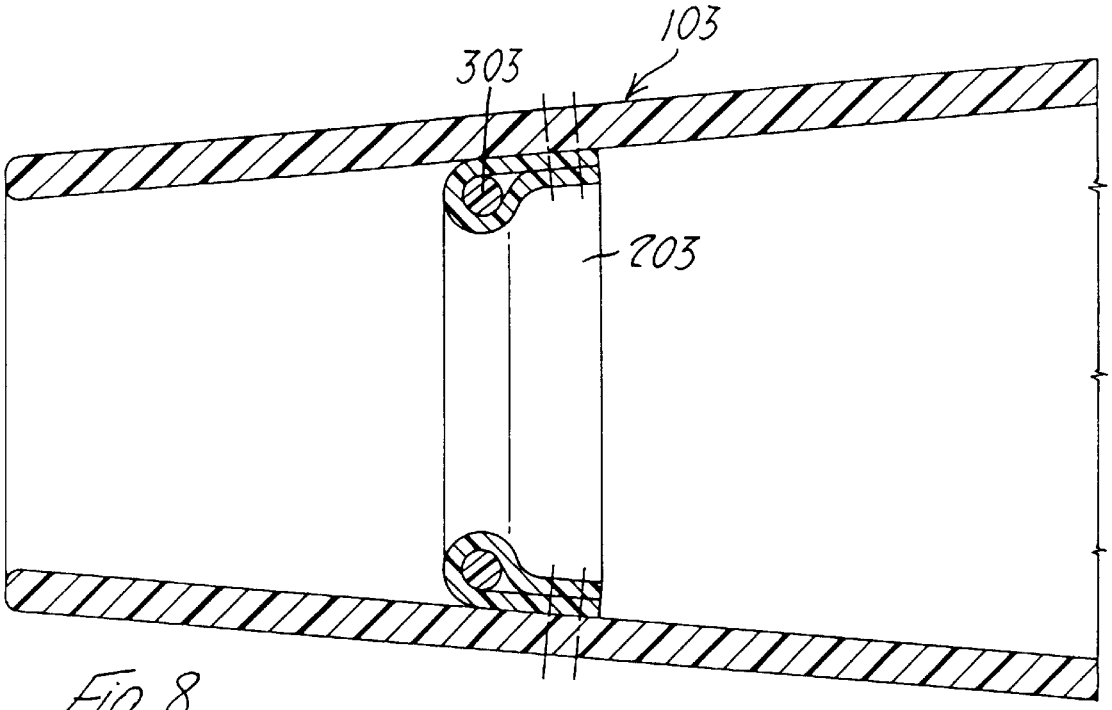
Figure 9:
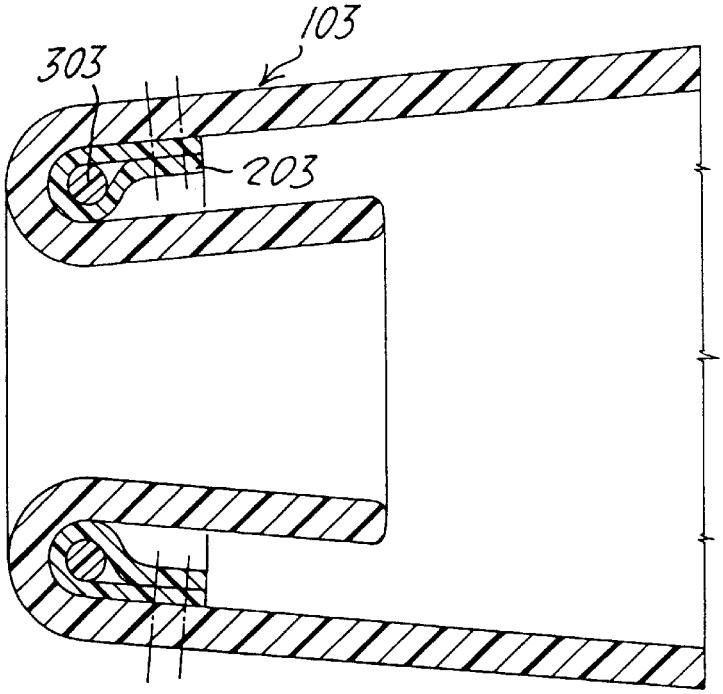

With reference to FIGS. 8 and 9, a further embodiment of the invention will be now described.

According to this embodiment, to inner side of the terminal portion 103 of the sleeves, a sheet like element 203 folded inwards and secured for instance by stitching to an inside area of the sleeves in proximity of the open extremities of same so as to form a tubular pocket in which a gas-free sealing element 303 made of elastomeric material is housed, the edges of said open extremities being in turn folded inwards, as shown in FIG. 9, so as to overlap said sheet like element 203.

Although the preceding description and drawings refer to a one-piece suit, two-piece suits which comprise jacket and trouser parts, may also incorporate the special features of the present invention.

Similarly, although reference was made to the sealing tubular pocket housing being a tape-like element, this tape-like element inside the tubular pocket may also be absent, without thereby altering the principle of the invention.

Furthermore, although this tape-like element is indicated as preferably having a circular cross-section, this element can have a cross-section other than a circular one, for example it may have an ellipsoidal or even prismatic cross-section.

Finally, it has proven particularly advantageous to make this tape-like element in the form of a tubular element rather than a solid one.

I claim:

1. A water-tight diving suit comprising: sleeve portions and trouser portions fastened to a jacket portion, said sleeve and trouser portions having open extremities; a sheet element folded inwards and secured to an inside area of the suit in a proximity of said open extremities so as to form a tubular pocket in which a gas-free sealing element comprising an elastomeric material is housed, edges of said open extremities being in turn folded inwards so as to overlap said sheet element.

2. A suit according to claim 1 wherein said jacket portion and trouser portion are made as a one-piece suit, and said jacket includes an opening providing access to the suit, said opening being closed by a zipper, at least one edge of said opening having a hem which is folded inwards and secured to an inside area of the suit so as to form a tubular pocket.

3. A suit according to claim 1, wherein said gas-free sealing element has a substantially circular or substantially prismatic cross-section, such that a width of said cross-section is slightly smaller than an internal width of the tubular pocket.

4. A suit according to claim 1, wherein said gas-free sealing element comprises a tubular element.

5. A suit according to claim 1, wherein said gas-free sealing element for said open extremities comprises a ring of elastomeric material.

6. A suit according to claim 2, wherein said gas-free sealing element for said access opening comprises a cord of elastomeric material fixed to ends of said access opening.

7. A suit according to claim 2, wherein said access opening is perpendicular to a longitudinal axis of the suit and is located across shoulder portions on a back of the suit.

* * * * *